United States Patent [19]

Cardoen

[11] Patent Number: 4,744,301

[45] Date of Patent: May 17, 1988

[54] SAFER AND SIMPLER CLUSTER BOMB

[75] Inventor: Carlos Cardoen, Santiago, Chile

[73] Assignee: Industrias Cardoen Limitada (A Limited Liability Partnership), Santiago, Chile

[21] Appl. No.: 913,712

[22] Filed: Sep. 30, 1986

[51] Int. Cl.[4] ..... F42B 13/50; F42B 25/16

[52] U.S. Cl. ..... 102/393; 102/223; 102/386

[58] Field of Search ..... 102/393, 394, 386, 364, 102/348, 493, 489, 223; 89/1, 817

[56] References Cited

U.S. PATENT DOCUMENTS

| | | | |
|---|---|---|---|
| 2,317,256 | 4/1943 | De Kurowski | 102/393 X |
| 2,539,643 | 1/1951 | Smythe | 102/386 X |
| 2,809,583 | 10/1957 | Ortynsky et al. | 102/393 |
| 2,874,639 | 2/1959 | Cardiff | 102/393 |
| 3,093,072 | 6/1963 | Pigman | 102/393 X |
| 3,970,006 | 7/1976 | Copeland et al. | 102/374 X |
| 4,005,655 | 2/1977 | Kleinschmidt et al. | 102/386 |
| 4,178,851 | 12/1979 | Brady | 102/393 |
| 4,498,368 | 2/1985 | Doane | 89/1.817 |

FOREIGN PATENT DOCUMENTS

| | | | |
|---|---|---|---|
| 2224832 | 11/1973 | Fed. Rep. of Germany | 102/386 |
| 2142418 | 1/1985 | United Kingdom | 102/393 |

*Primary Examiner*—David H. Brown

*Attorney, Agent, or Firm*—Ladas & Parry

[57] ABSTRACT

The design of low cost, safe to use cluster bombs is a prime military objective of aircraft weaponization. Present barriers to cost and safety result from the needed complex dispersion system of the submunition cargo. Spin-up, propulsion of the submunitions, projection of the submunitions and cutting of the walls of the bomb require usually explosives or propellants and always involve complex designs, which are costly to fabricate. The present invention overcomes the deficiencies of the prior art by providing for a novel, simple and inert ejection and adequate dispersion system of the submunition cargo, of multi-purpose, anti-tank, anti-personnel, incendiary bomblets wherein the bomblets are dispersed through the nose end and the aerodynamic forces of the air impinging on the high speed bomblets cause these to fan out and provide for an area coverage which is equivalent to that obtained by the prior more complex and costly dispersal systems.

8 Claims, 11 Drawing Sheets

SAFER AND SIMPLER CLUSTER BOMB

BACKGROUND OF INVENTION (1) Field of Invention

The present invention relates to cluster bombs and more specifically to a bomb assembly, comprising a cylindrical casing adapted to contain a cargo of munitions and a safer and simpler system for the ejection and dispersal of these munitions from the cluster bomb.

(2) Description of Related Art

Clustered bombs have been used extensively in trying to increase the effectiveness of air dropped munitions. These have been used since prior to World War II and basically involved the combination of a number of smaller bombs held together by some frangible or breakable link. These could be dropped together and would separate at the time of drop or during the descent so that they would have separated in distance from each other in the air and retain the capability, individually to damage or destroy the targets which they hit or which were in their area. U.S. Pat. No. 2,604,043 shows an example of such clustered bombs and the manner in which they were held together and subsequently were permitted to separate.

Parachutes have been used for retarding bombs and have been used to initiate the drop of repeated single parachute bombs, wherein a detent mechanism accomplishes that release as shown in U.S. Pat. No. 2,317,256.

Similarly large canisters were rear ejected from a main, still larger container by the release of a parachute, pulling out one canister which is hooked to a static line to the next parachute, pulling this out, to further pull out the next canister, and so on. This is shown in U.S. Pat. No. 3,940,443.

In still another patent, bomb clusters have been opened during the deployment of a parachute where the downward fall of the cluster opening permitted some dispersion of the small numbers of bombs in the cluster as shown in U.S. Pat. No. 2,874,639.

All of the above involved bomb clusters which were in free fall and which opened after that downward free fall and gave some dispersion to the few bombs of the cluster.

In time, it became apparent that it would be more advantageous to further reduce the size of these smaller bombs since computations, dating back to Leonardo DaVinci showed that anti-personnel effectiveness could be greatly improved by accomplishing this. Studies after World War II had shown that relatively small bombs, considerably smaller than those used in clustered bombs, could destroy tanks, armored vehicles, trucks and similar military vehicles. It soon became apparent that it was difficult and costly to place such larger numbers of much smaller bombs in clusters and reliably and safely hold them together for aircraft drop. This led to the placement of such clustered smaller bombs within the confines of a larger bomb, acting as a container for the smaller bombs, where, after drop from the aircraft, the bomb would open and somehow disperse the cargo of the contained smaller bombs over a target area. An example of this is U.S. Pat. No. 2,809,583.

The initial and continuing problem in trying to accomplish the ejection and dispersion of the cargo of such larger bombs has been the means of accomplishing this objective. Actually, two types of clustered dispensing systems came into being. One is commonly known in the U.S. as Slung Under Unit Dispensers or SUU Dispensers. These are hung under aircraft and directly used to dispense a cargo of munitions, through RAM air or propellants with the dispenser container retained on the aircraft. The United States Air Force has been using such SUU dispensers extensively. Here smaller bombs or other munitions are dispensed usually out of the rear end of SUU dispensers as a result of forces applied against the cargo to cause it to eject rearward. Thus Ram air was used frequently to eject the cargo of munitions as is shown in U.S. Pat. No. 3,308,719.

In a related application, such dispensers were replaced by a nest of rocket launcher tubes that may cluster a larger number of rocket launchers to propel or project rockets in the forward direction at the target. The 2.75 inch rocket launcher system used on aircraft is the best of such examples. See also U.S. Pat. No. 3,269,268.

The United States Navy was of the opinion that the aircraft dispensing of munitions, requiring a flight over the target would result in excessive losses to enemy air defenses. The Navy consequently developed an alternate form of dispensing clustered munitions, which would not require a flight over the target. Instead of leaving the dispenser on the aircraft during the dispensing of the munition, the dispenser itself was dropped from the aircraft and designed in a missile configuration, so as to fly toward the target, while the aircraft would turn so as to permit the aircraft to be out of gun reach of the defending gun positions. In one tactical use, this dispenser, which is now known as a cluster bomb, would be dropped from great altitudes at long distances from the target where the aircraft was out of reach of most air defense weapons. The forward velocity of the aircraft would to a large extent be retained by the aerodynamically shaped cluster bomb and would permit it to fly a long distance in the direction of the target before the cargo of munitions would be dispensed from that bomb to cover all or part of the target area.

In a second tactical use the aircraft would be flying at a low altitude. As it approached the target area, it would fly upward and release the cluster bomb on the "up-leg" of flight. This upward angle of flight of the cluster bomb would cause it to fly in a mortar shaped flight configuration. The cluster bomb, which is in effect a missile would fly a considerable distance toward the target area, to discharge the cargo of submunitions over the target area. The aircraft would turn and not be required to fly over the target area.

A major problem in the design of a cluster bomb as described above involved the complexity and resulting cost, as well the safety of such bombs. A cluster bomb had to be fuzed such that the dispensing of smaller bombs, mines or grenades could be conducted efficiently and reliably. Consequently, various designs of the cluster bomb were produced to properly contain and be able to discharge the cargo of munitions. These designs used a number of basic techniques, including combinations of such techniques to eject and disperse the cargo of munitions. This required the packing of the munitions such that they could be dispersed from the cluster bomb without damage. It further was a desire to pack the maximum cargo of munitions within the cluster bomb. As a result of these objectives a number of cluster bomb designs were produced and patented. Some initial designs used a simple unthreading means of the clamping means provided by a turbine to open the cluster and release the cargo. (U.S. Pat. No. 2,450,910). This was unsatisfactory since the timing of release became important. Consequently new designs were made which, could be used with time fuzes and which at a preset time of the fuze, would cause the ejection and discharge of the cargo.

A large number of ways of opening up of the cluster bomb to disperse the cargo of munitions were devised. Gas pressure was used to break open a frangible jacket (U.S. Pat. No. 2,802,396). The skin was removed by explosives in the form of linear shaped charges (U.S. Pat. No. 2,996,985). This is used in the U.S. Rockeye II Cluster Bomb. The casing of the bomb was destroyed by pyrotechnic material (U.S. Pat. No. 3,016,011). Hot gas was used in a piston ejection system (U.S. Pat. No. 3,295,444). In related clustered rocket pods used on aircraft these used propellant projection of the individual rockets (The 2.75 inch rocket system which was under a U.S. Project Manager is an example of such a clustered weapon system). Bomblets have been dispersed through the ogive of such rockets (U.S. Pat. No. 4,488,488). Submissiled air to surface warheads, which closely resemble cluster bombs used a propellant diaphragm deployment mechanism for dispersing the cargo of munitions (U.S. Pat. No. 3,865,034). Gas generating foam was placed between the munitions, to disperse the same on ignition (U.S. Pat. No. 4,063,508). High speed spin as a result of propellant burning was another means of dispersing the cargo of munitions (U.S. Pat. No. 4,488,489). Ejection of subunits containing a cargo of munitions from a guided missile was still another dispensing technique (U.S. Pat. No. 4,498,393). In the case of munitions having a circular cross section a sudden change of acceleration or deceleration produced by propellants is used to eject the cargo sideways from a plurality of receptacles arranged such as to induce spin (U.S. Pat. No. 4,555,971).

The following prior art discussed below is also to be considered in relation into this invention: U.S. Pat. Nos. 4,005,655, 4,273,048.

U.S. Pat. No. 2,317,256 involves a cluster of bombs dropped from an aircraft. A parachute is used to retard the descent of the container containing that cluster. The bomb is adapted to automatically and sequentially at predetermined intervals, release the bombs so as to drop these bombs over a wide area.

U.S. Pat. No. 2,874,639 involves a bomb which deploys a parachute and on deployment of that parachute ejects a package of cargo out of the nose section. This does not involve the dispersion of the cargo itself, which is the subject of the instant invention.

U.S. Pat. No. 4,005,655 shows the use of an inflatable stabilizer/retarder to slow down the flight of a bomb. This involves a flexible, inflatable, conical shaped bag which is stored in the tail segment of the bomb for deployment where a high drag mode of operation for the weapon is required. It is also small in size and inexpensive.

U.S. Pat. No. 4,273,048 shows a mine field clearance round where a parachute is deployed from the tail section to slow down and orient the same so as to face down.

U.S. Pat. No. 4,488,488 shows a parachute projection system for submunitions which are explosively projected through the ogive of a rocket over a tank containing area. The explosive projection created severe problems which U.S. Pat. No. 4,488,488 attempted to overcome, while retaining the explosive projection. The elimination of any explosive projection is one of the basic objectives of the instant invention.

U.S. Pat. No. 4,498,393 shows the ejection of dispensing units from rockets or shells using parachutes to slow down these dispensing units. These subsequently further dispense a cargo of mines, bomblets or subsidiary projectiles in order to obtain the desired dispersion of this cargo of munitions. Here the ejection of these dispensing units is obtained by either strongly braking the dispensing units or instead braking the carrier, so as to eject the dispensing units whether through the tail or the nose section. This is not used to obtain dispersion. It is used to obtain the ejection and to prevent impact between the carrier and the dispensing units.

U.S. Pat. No. 4,555,971 shows the use of propellants to accelerate or decelerate a carrier projectile and to eject, side launch and disperse the contained cargo of submunitions from rifled tubes within the carrier projectile. It teaches the use of acceleration or deceleration to launch such submunitions, but depends on chemical propellants to achieve this. It further requires complex rifled tubing in order to obtain the desired objectives. It is the use of propellants and the complexity of such devices which the instant invention is designed to overcome.

All of the prior stated methods of producing ejection and satisfactory dispersion systems for their cargo of submunitions suffer in that most involve complex and costly designs, difficult to manufacture. Most use explosives, propellants, pyrotechnic or gas producing systems to expel the cargo and to provide tangential velocity so as to disperse the cargo.

Any energetic material has the potential of deteriorating in storage or handling such that it becomes inoperable. This is especially applicable where these energetic materials are chemical disperal systems and are subjected to higher temperatures, high humidity conditions such as would be found in the storage compartments of ships and in tropical areas, where these cluster bombs are frequently used. All energetic materials pose a degree of danger in storage, handling and in use on aircraft.

There has been a continuous desire to produce lower cost, easier to fabricate and safer to handle cluster bombs. Normally, the container main body of cluster bombs are fabricated from metal or plastic components and, therefore, cluster bombs can be manufactured competitively in a very large number of industrial organizations. Competition drives the cost down to a minimal amount. But, once energetic materials, such as propellants, explosives or pyrotective materials must be attached to that body or container, then the competition is effectively eliminated since only one or two special facilities in the locality can handle such energetic materials. Governmental restrictions severely limit the licenses given out to organizations authorized to handle explosives, propellants or pyrotechnic materials. These organizations need extra land and special facilities to store these energetic materials. Operators need special training and receive higher pay. Storage, handling and transportation requirements are severe and increase costs. There is always the potential of accidents with explosives, propellants or pyrotechnic materials. This forces special handling of loaded items. Even cluster bomb bodies containing small amounts of explosives require special handling and escort of police or similar protection during transportation, especially across bridges and through tunnels. All of these considerations cause a higher cost for energetically loaded cluster bomb bodies as compared to inert bodies which do not contain explosives or propellants.

Cost becomes an important consideration when extensive competition in international sales of cluster bombs occurs. Thus, companies in countries such as France, England, Israel and the United States compete for international sales of cluster bombs containing dual purpose, anti-tank, anti-personnel bomblets to countries which had conflicts with other countries and needed such cluster bombs for their defense. The result of these considerations has been that a need exists for cluster bombs, whose bodies could be manufactured without explosives, propellants or pyrotechnic materials so as to reduce the prior stated cost in transportation and manufacturing and to overcome safety problems. Similarly, complex designs could not be used since costs would be excessive.

It is consequently an objective of this invention to overcome the prior higher cost of fabrication of such bombs and the inherent safety problems that result from the energetic, propellant, pyrotechnic or explosive content used in some bombs to release the cargo of munitions. It is another objective of this invention to provide for a cluster bomb that does not require energetic materials to discharge and/or disperse the munitions, yet retaining the prior dispersion pattern of those cluster bombs, but thereby increasing the safety and reliability of such cluster bombs. It is further another objective of this invention to provide for a cluster bomb which is simpler in construction and therefore easier to manufacture than prior art bombs and yet able to disperse in a proper pattern a cargo of anti-tank, anti-personnel, dual purpose bomblets. Here, in fact, incendiary action has been added to result in a multi-purpose bomblet.

Consequently one object of this invention is to provide for a body or container for the submunition cargo that could be totally devoid of any energetic material during the manufacture and transportation thereof to the loading plant. This would provide for a much lower cost of fabrication, transportation and storage thereof. Lacking such energetic materials increased safety in manufacture, transportation and storage of such bodies or containers can take place. A further objective was to eliminate all explosives, propellant and pyrotechnic materials other than those normally contained in initiators, detonators or low energy detonating cord from the cluster bombs, since propellants and pyrotechnic material are deteriorated by higher temperature and higher humidity conditions, their elimination increases the high temperature and high humidity storage characteristics of the cluster bombs. Eliminating the larger amounts of all of these energetic and consequently hazardous marterials increases the safety in the use of the cluster bombs of this invention since malfunctioning would result in "failsafe" performance, rather than a more hazardous energetic event.

Yet, in spite of these advantages, which drive costs down and provide for a much safer to use cluster bomb, this invention provides a mechanism of retaining the dispersion or dispersal capability of the prior art, which is obtained in the prior art by complex and costly dispersal systems employing spin and energetic ejection systems. The present invention obtains the dispersion by ejecting the bomblets through the nose section, while the body or container is retarded and pulled away from the bomblets. The bomblets traveling at a high speed forward velocity upon entering the windstream can only be deflected outwardly as a result of their dense packing in the cluster bomb. This causes the bomblets to angle their direction off-axis with respect to the flight of the cluster bomb and to disperse, resulting in a dispersal pattern which is equivalent to that obtained by the prior art.

In the prior art, where spin and explosive dispersion was used, the load of bomblets were ejected sideways, while the axis was parallel with the cluster's longitudinal axis. This resulted in high drag forces to be exerted on the bomblets and reduced the side dispersion. In the present "forward projection mode" this is no longer the case and results in a dispersion equivalent to this prior art, but without the complexity.

SUMMARY

This invention pertains to cluster bombs and is an improvement in the construction from the point of view of safety and economical fabrication, while maintaining the desired cargo dispersal patterns on the target equal to that achieved by the prior art.

Where most such prior bombs needed propellant, pyrotechnic or explosive dissemination of their "pay load" of munition sub-units, which could consist of bomblets, mines, grenades or missiles, this is no longer the case here and simplifies the fabrication process. This cargo of ammunition can be delivered, deployed or ejected from cluster bombs, rockets or missiles in the air, over target area. Where the potential existed that the propellant or explosive disseminating system might accidentally malfunction and cause serious damage in fabrication, storage, transportation or when used on the aircraft, this is no longer the case in this invention which eliminates such energetic dissemination material and relies instead on a novel mechanical disseminating process.

In the cluster bomb of the instant invention, the functioning of a time fuze transmits a signal (or activation) to the tail stabilizer section which contains within it a drag means, which is activated. The drag means is deployed and suddenly "brakes" or slows down the bomb and causes the munition cargo located in the body or container section to shift or move toward the nose area. Simultaneously, or prior to this braking or slowing down action, the front end of the bomb is opened in any of large number of ways. In the instant invention, a cylindrical body or container is also used to contain the munition cargo, so as to permit these munitions uninterfered ejection out of the cluster bomb as a result of their own inertia during the sudden slowing down of the cylindrical container of the cluster bomb and the near simultaneous opening and discarding of the entire nose section to permit the munition cargo to exit and to be dispersed by the onrushing airstream. Ejection of the cargo is accomplished by the sudden slowing down of the air born cluster bomb, rocket or missile. This causes the munition cargo in the foam packing in which it is contained to set forward and exit through the nose section, the nose section having been either previously opened or opened in the process. The opening of the nose section may be accomplished by the cargo directly, by a separate inertial mass, or both. Or the nose cone can be forced open by other means. Thus the nose section may be weakened to yield to the force of the cargo, the inertial mass, or other means, as the body or container is suddenly slowed down. When this happens, the inertial mass and/or the cargo of bomblets sets forward moving to the nose section.

The sudden slowing down of the cluster bomb, rocket or missile is preferably accomplished by an inflatable stabilizer drag retarder deployed from the tail section, (A drag device, which is especially applicable to this invention is described in U.S. Pat. No. 4,005,655) of sufficient size such that it imparts a sudden deceleration to the cargo of munition of sufficient magnitude as to overcome the combined holding forces of inertia, that of the packaging materials and incident air and to overcome the pressures from the inrushing air through the open nose, so as to cause that cargo to set forward, and move and exit through the nose section. As noted in said patent, such inflatable stabilizers are small in size and inexpensive to fabricate.

The slowing down of the cluster bomb, rocket or missile can be accomplished by drag devices such as a conventional parachute, a rotating parachute, a combination of a pilot parachute and a main parachute or an inflatable stabilizer/retarder. Alternatively, slowing-down can be accomplished by the deployment of retrorocket propulsion of sufficient force to cause the shear of the cargo of ammunition from the container walls and to overcome inertia, and to be of sufficient impulse (long enough duration time of that force) to cause all of the cargo to shift forward toward the nose section and exit through the nose section before the retrorocket propellant has burned out.

The nose section can be opened either by the initial fuze action providing energetic forces to open that section through explosives, propellant or pyrotechnic means or, instead, where a spring loaded mechanism is activated to open that nose section, either from the rear or directly located in the nose section and where the same is activated subsequent to the fuze action. Thus explosives can be used directly to blow the nose section apart by using, for example "sheet explosive" on the inside of the nose sections. Propellant charges could be used to blow the panels of the nose section outwards. Neither of these processes would have any deleterious effect on the bomb body or container. Pyrotechnic materials could be used to cut the nose section apart, so as to have it fall away from the bomb. While less desireable than the preferred embodiments, these are available options for opening of the nose section. The nose section in the preferred embodiments is divided such that it will rupture after fuze action and the forces being applied to that section will split it apart, and the nose section is further opened by aero-dynamic pressure of the incident onrushing air so as to open to the full diameter of the munition cargo containing cylindrical body, so as to permit ejection of the munition cargo thereof through this open nose section.

BRIEF DESCRIPTION OF DRAWINGS

FIG. 11A shows details of sectional view of segment "V" of FIG. 8 showing the spring loaded cable or lanyard system in the base used to open the closure and to release the parachute, or inflatable stabilizer/retarder. The FIG. 11A is a split view which shows the system before functioning, while

DESCRIPTION OF THE PREFERRED EMBODIMENTS

Figure 1:
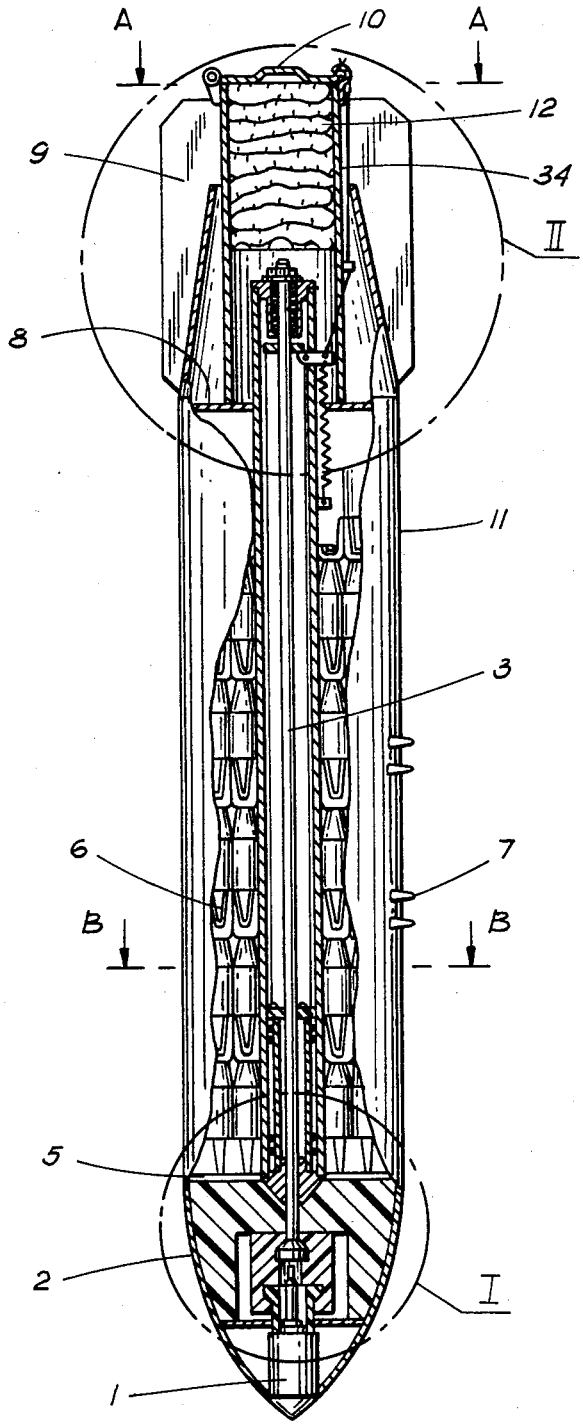
FIG. 1 is a longitudinal, axial, sectional view through a cluster bomb assembly of a preferred embodiment A of this invention.
Figure 2:
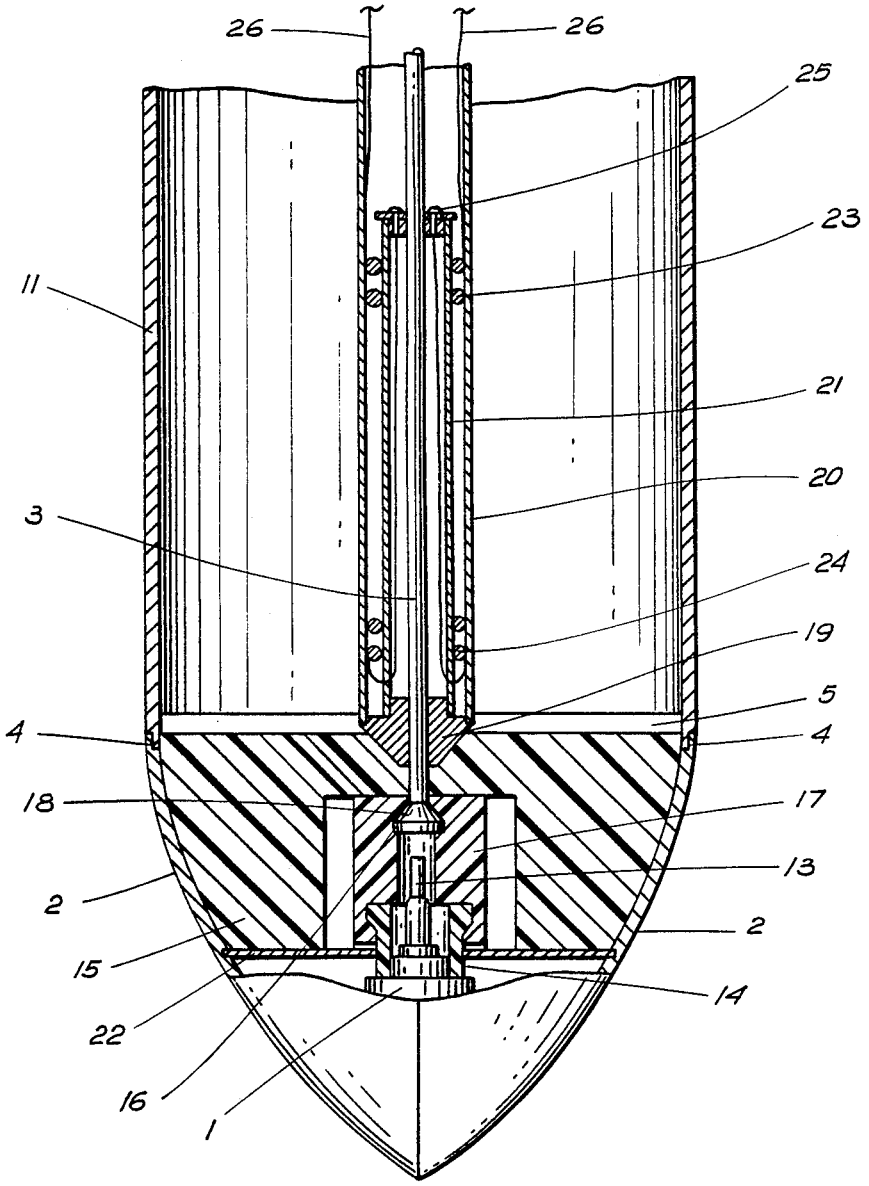
FIG. 2, detail "I" is a detailed longitudinal, axial, sectional view of the nose section of preferred embodiment A detailed as "I" in FIG. 1.

The present invention is a dispensing system for ejecting, for example, a cargo of anti-tank, antipersonnel, incendiary, multi-purpose munitions from a carrier cluster bomb in the preferred mode. FIG. 1, Preferred Embodiment A and FIG. 8, Preferred Embodiment B show two preferred embodiments of the invention. Both of these preferred embodiments utilize a drag device, here an inflatable stabilizer/retarder connected to the tail section of the cluster bomb. The drag device is ejected on fuze functioning out of the tail end stabilizer section during which process the nose section is opened, so that the sudden radical deceleration of the bomb causes the cargo of munitions located in the body or container to set forward and, as a result of their inertia move in the direction of the nose to exit out of the nose section and out of the cluster bomb. a. Preferred Embodiment A FIG. 1, shows, in general, one preferred embodiment of a configuration of the dispensing system related to the carrier cluster bomb. The lugs 7 are used for suspending the cluster bomb on aircraft. Section "I" comprises the nose section, composed of a programmable time fuze 1, a nose segment 2, capable of being severed. As seen in FIG. 2 it is held together by joint 4 but capable of being forced apart by the explosion of a detonator 13, which may be a delay detonator so as to provide additional safety in case of mal-functioning of the programmable time fuze (FIG. 2). The split nose segment could very readily be composed of a larger number of segments capable of being severed. A front compartment separator or bulkhead 5 separates the nose section from the mid section cylindrical shaped body 11 of the bomb which contains the bomblet munition pay load 6. A nose end bulkhead 22 supports the fuze within the nose segments.

Figure 5:
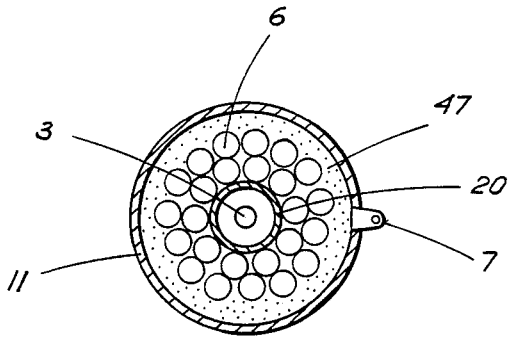
FIG. 5, is an axial cross sectional view of section B—B in FIG. 1.

FIG. 5 is a horizontal cross section at point B—B of FIG. 1 showing the bomblet munition pay load 6, encased in a cushioning foam 47 (as shown in FIG. 5)

contained within the cylindrical shaped body or pay load container 11. It also shows the rod 3 contained within the central tubular cylinder 20 surrounded by the pay load 6. Further shown are the lugs 7 used to suspend the cluster bomb on aircraft.

Figure 4:
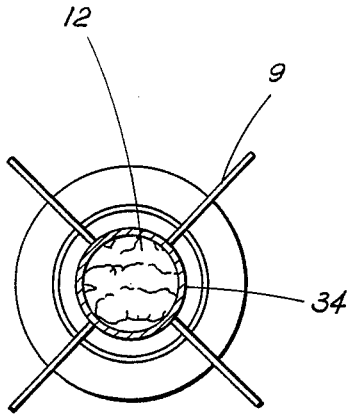
FIG. 4, is an axial, cross sectional view of segment AA of FIG. 1, at section A—A.

In FIG. 1, a rear end compartment separator or rear bulkhead 8 closes off the munition containing, cylindrical shaped body or pay load container 11 from the rear end, stabilizer section generally shown within "II". This segment is composed of four 90° spaced apart fins 9 and contains a parachute 12 or similar drag device, such as an inflatable stabilizer/retarder (see also FIG. 7) in a compartment 34 closed off by a closure 10. The fins 9 provide for a stable flight characteristics to prevent tumbling of the cluster bomb after launch. FIG. 4 shows a cross sectional view at point A—A of FIG. 1 of that compartment section, showing the parachute compartment cylindrical walls 34, the "parachute" 12 and the four fins 9.

The front end section of FIG. 1, "I" is detailed separately in FIG. 2. FIG. 2 shows the nose sections capable of being split, or segmented by the functioning of the detonator 13. A rod 3 extends into it and is held in a conical shaped cavity 16 within the support 17 by being connected to a conical segment 18 within the support 17. The fuze is supported by housing 14 of the nose segment which is secured in the support 17. The front bulkhead 5 of the cylindrical shaped body 11, containing the bomblet pay load 6 is held at joint 4 to the split nose sections 2. A central tubular, cylinder 20 is supported against the front bulkhead by a wedge shaped support 19 such that it fits into the interior of that cylinder and permits the rod 3 to freely pass through it. It is also held by the rear end bulkhead 8, passing through it. Central guides 23 or 24 made of washers or springs surrounding a cylindrical inner tube 21, hold the rod 3 central to the central tubular cylinder through a washer 25 or similar holding means and the wedge shaped support 19 and maintain it in that position. A frangible matrix 15 holds the segments of the nose end together. The metal rod 3 is connected or machined to have a conical section 18 which is wedged in the support 17 to that it cannot move. A detonator 13 is located in the segment of the nose that supports the rod (support 17) and prevents it from movement. The explosive power or brisance of that detonator 13 is such that it is able to destroy the segment holding the wedge shaped section 18 of the rod 3 splitting the support 17 and expanding the frangible matrix 15 causing the nose section to break apart.

Figure 3:
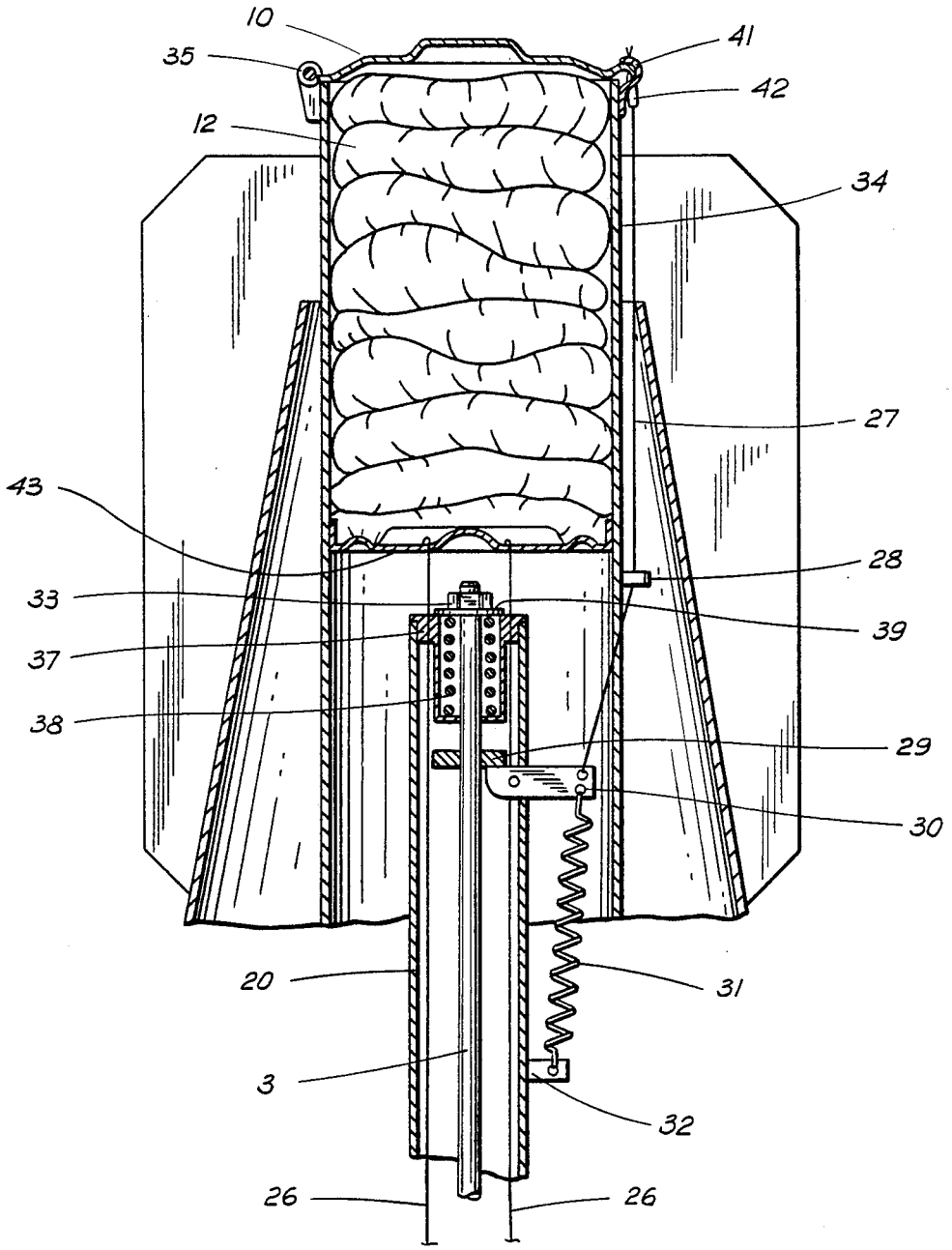
FIG. 3, is a detailed longitudinal, axial, sectional view of the base end section of this preferred embodiment detailed as "II" in FIG. 1.

Detail "II" of FIG. 1 is shown in FIG. 3. This shows the tail section that then comes into action. The rod 3 is secured within the central tubular cylinder 20 by a nut 33 against a closure 37 secured in the central tubular cylinder 20. Within that closure is located a cylindrical cavity, holding spring 38 spring loaded in a contracted condition and pushing against a metal washer 39 held by nut 33. A spring 31 is held in an expanded conditions in a stable hooked position 32 and a hinge 30 prevented from movement by washer 29 which is firmly secured to rod 3. The hinge 30 is connected to a cable or lanyard 27 running through a guide 28 to pin 42 securing the lip 41 of the closure 10 of the cylindrical wall of the parachute compartment 34 where closure 10 is hinged to compartment 34 by hinge 35 on the side opposite to pin 42.

Figure 6:
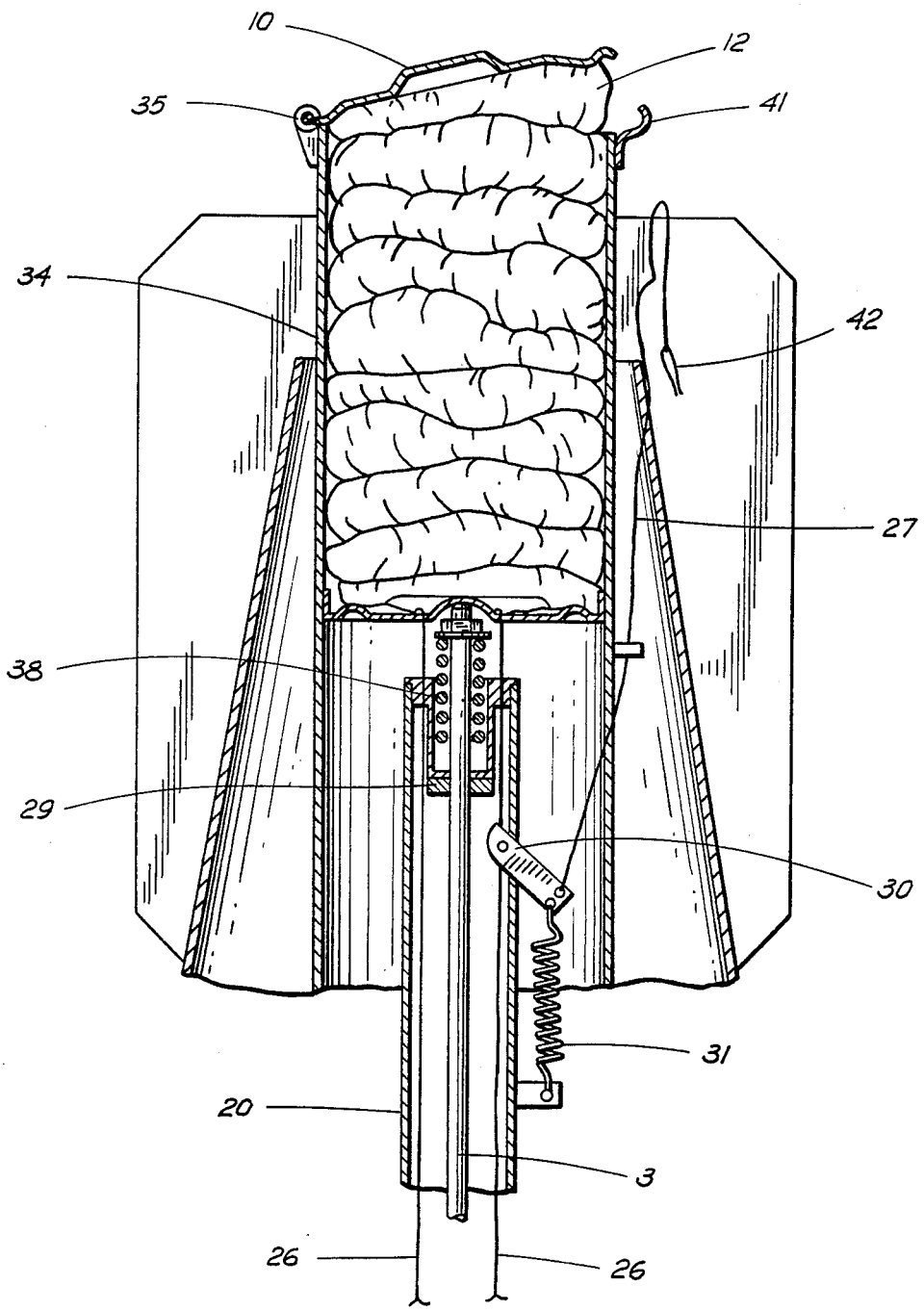
FIG. 6 shows the opening of the closure of the parachute compartment and the initial release of the drag device or parachute.

As shown in FIG. 6, when rod 3 shown in FIG. 2 is no longer supported by the wedged segment 18 in the support 17 on the forward end because of the functioning of the detonator 13 and break-up of the support, then as shown in FIG. 6 the compressed spring 38 expands and moves the rod 3 contained within the central tubular cylinder and the connected washer 29 to impact the movable facing section or front end face 43 of the parachute compartment 34. As shown in FIG. 6. This permits the hinge 30 to tilt and now permits the spring 31 to contract and transmit that pull through cable 27 and a cable support 28 to withdraw a pin 42 which secured the lip 41 of the closure 10 thereby releasing the "parachute", an inflatable stabilizer/retarder 12 to permit it to deploy as shown in FIG. 6. The spring loaded pressure of spring 38 pushing against front end face 43 aids in opening the closure 10 and pushing the parachute 12 into the air stream. The closure 10 opens sufficiently so that the aerodynamic forces of the high velocity air catches and further opens the cover and pulls it and the attached conical shaped "parachute" into the air stream to inflate.

With reference to FIGS. 2, 3, and 6, one or more cables 26 are fixed to washer 25 located in the rear end of cylindrical inner tube 21, and extent forward toward the cylinder's front end, emerging in front of front central guide 24, and continuing rearward between central cylindrical tube 20 and the cylindrical inner tube 21, emerging through the rear end of cylinder 20, where the cables are connected to the breaking means compartment 34 front end face 43.

When the front end face 43 is pushed rearward by spring loaded rod 3, cables 26 are pulled rearward at their ends connected to front end faces 43, while their ends connected to washer 25 draw the washer against inner tube 21 so that its front end compresses the wedged shaped support 19 to help frangible nose separation.

Figure 7:
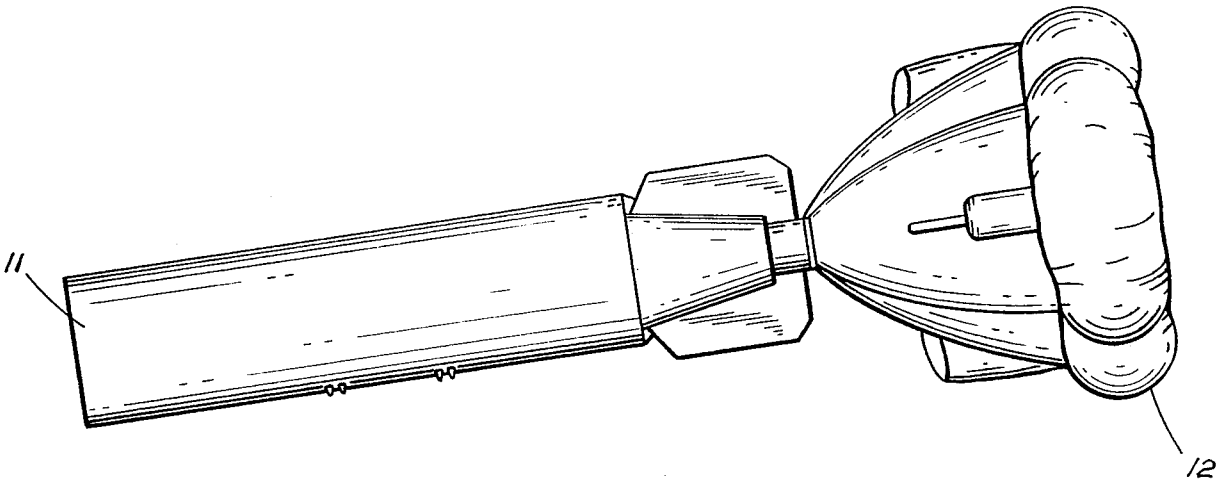
FIG. 7 shows the cluster bomb shortly after deployment of the inflatable stabilizer/retarder of the embodiments and the discarding of the nose section.

While as shown in FIG. 6 the unlatching of the closure 10 and deployment of the "parachute" 12 is taking place, the segments of the nose section have been broken apart by the explosion of the detonator 13 and the parts of the nose section, including the fuze are fully discarded as shown in FIG. 7, prior to the time that the "parachute" inflatable stabilizer/retarder 12 has deployed. Whereafter the inertia of the bomblet munition pay load 6 of FIG. 1 causes this cargo to shift toward the nose and exit through the open front into the airstream where they are aerodynamically dispersed by that airstream. This dispersal is like that discussed in Preferred Embodiment B, next.

b. Preferred Embodiment B

Figure 8:
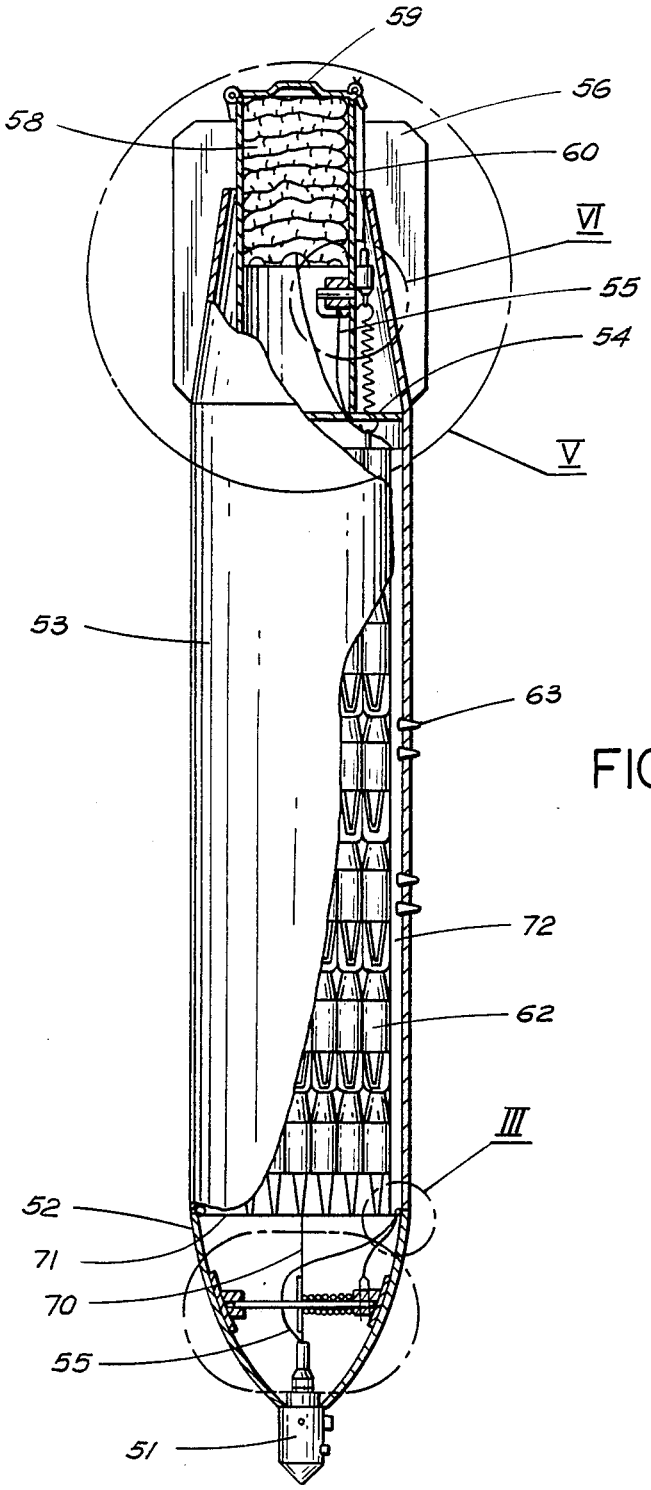
FIG. 8 is a longitudinal, axial, sectional view through a cluster bomb assembly of another preferred embodiment, B, of this invention.
Figure 10:
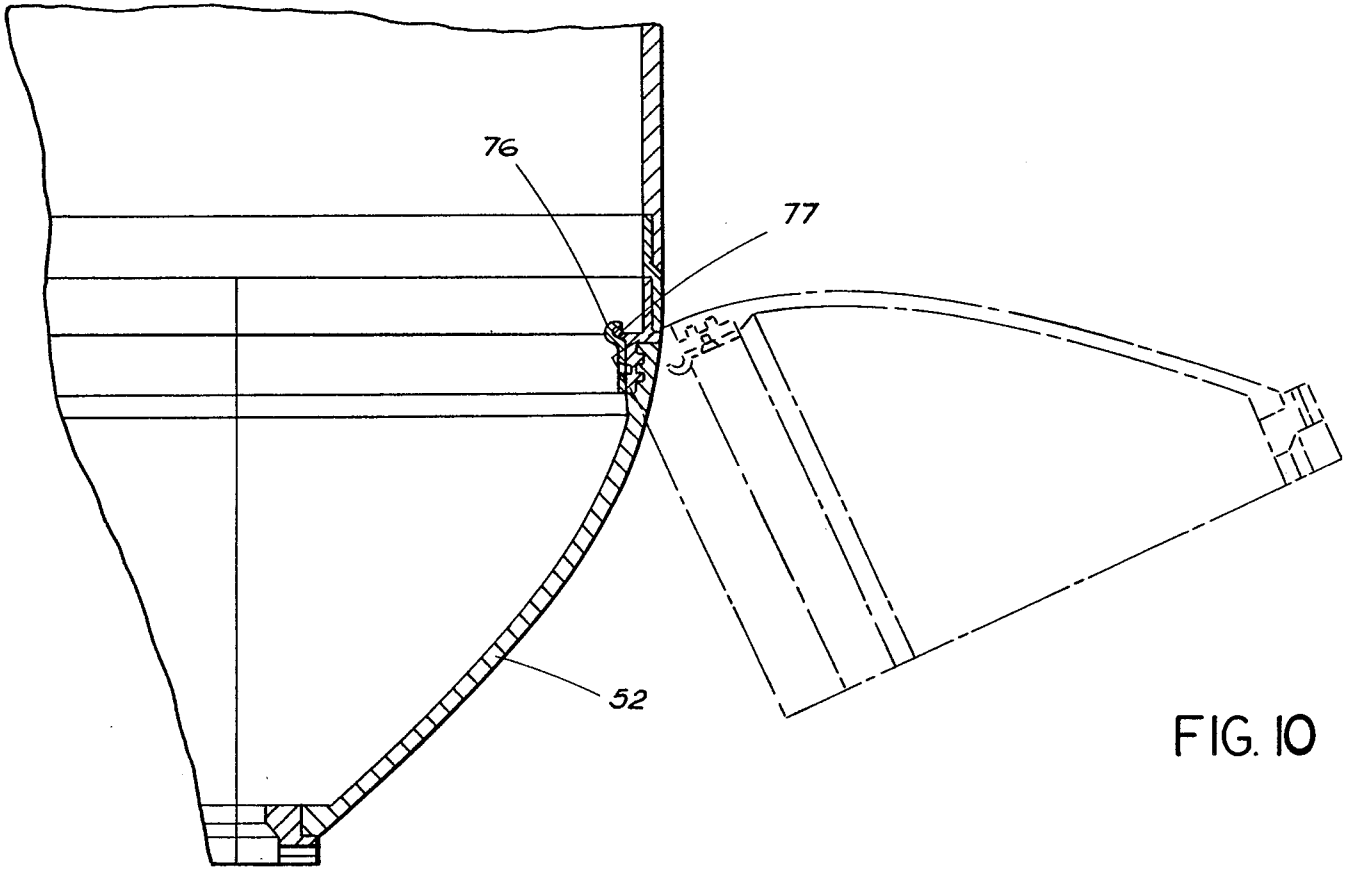
FIG. 10 is a longitudinal sectional view of segment "III" in FIG. 8 showing the open hinged nose section on opening and just before separation from the remaining cluster bomb.

FIG. 8 shows in general a longitudinal sectional view through a cluster bomb of a second preferred embodiment B of the configuration of the dispensing system thereof. The functioning of the cluster bomb, after drop from the aircraft while suspended previously by lugs 63 is provided by the programmable time fuze 51. The fuze is held to the bomb within two split nose sections 52. The two sections are open hinged, as in section "III" FIG. 8, and as in FIG. 10; 76, 77, so as to permit complete separation from the bomb, upon opening of the halve sections as shown in FIG. 10.

The output of the fuze is a detonator within the fuze 51, which is connected to low energy detonating cord 55. This low energy cord detonating contains very little explosive and when exploding fully contains the explosive power within it, so as to be incapable of doing any damage, and therefore to be completely nonhazardous in its use. This low energy detonating cord transfers the explosive energy to a detonator 84 (FIG. 11A) contained in the tail, stabilizer section and is used to cause the opening of the tail closure 59 of the tail end parachute compartment 60 which permits a retained conical shaped inflatable stabilizer/retarder 58 to be released to the air stream as shown in FIG. 11B, and be inflated.

Returning to FIG. 8 the two or more nose sections 52 are held together by weak joints 70 capable of being split and the halves separated by the release of a compressed spring mechanism shown as Section "IV" in FIG. 8.

Figure 9:
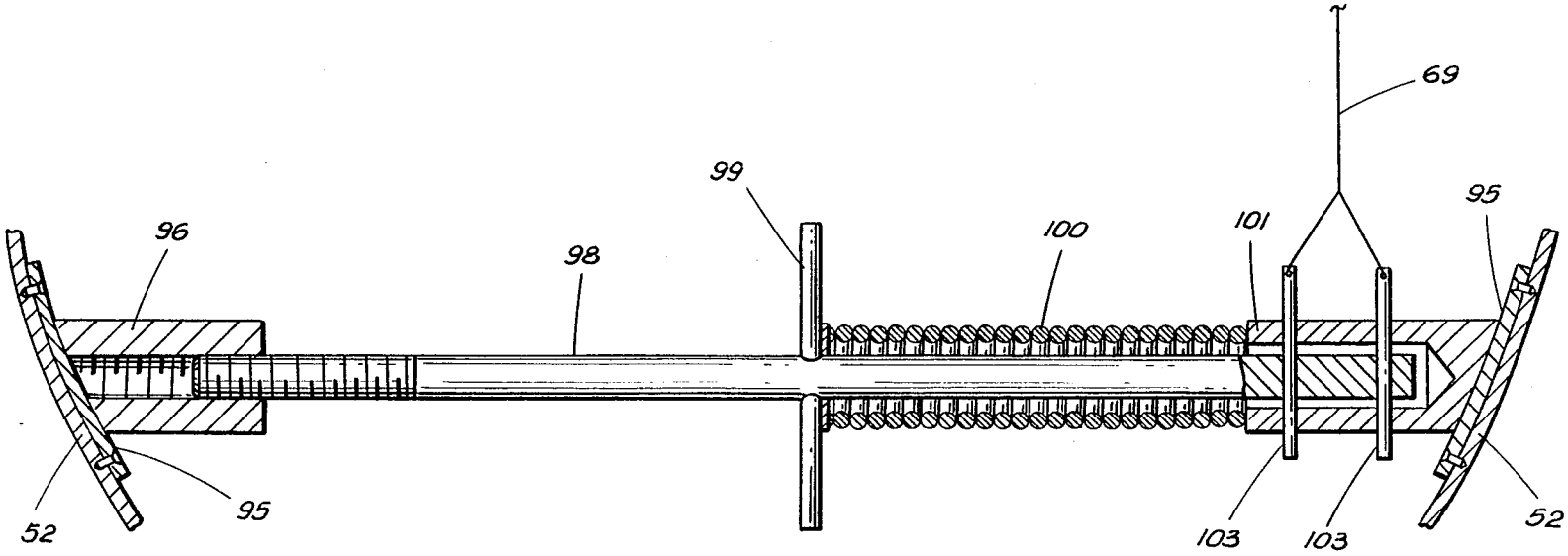
FIG. 9 shows the spring loaded mechanism used to open the nose section upon withdrawal of two pins holding the mechanism from performing that function and which is shown as segment "IV" in FIG. 8.

The details of the compressed spring mechanism are shown in FIG. 9. The same consists of two plates 95 that are adhered to opposite nose sections 52. Adhered to one side is a hollowed sectional piece of a rod 101 with a cylindrical cavity configured so us to permit a rod 98 to be placed into that hollowed end. With rod 98 placed in the hole and nearly bottomed, two holes were drilled through the rod 98 of such size as to permit insertion of two pins 103 to prevent the withdrawal or the rod from the cylindrical hole. A compressed spring 100 is held in that compressed condition by a pin 99 placed in a hole through the rod 98 and by the other end where the pins 103 prevent the movement of the rod 98 from the cavity in the rod 101. On the opposite end, the plate 95 is adhered to a section of pipe 96 threaded such that it will permit the threated insertion of the rod 98 in a straight line between two opposite sections of the nose FIG. 9, 52.

The nose section is connected by the prior stated hinge system, III, FIG. 8 to the cylindrical munition compartment 53, which contains the bomblet munition pay load, 62, such as anti-armor, anti-personnel, incendiary, multi-purpose munitions. The discarding of the nose section leaves the forward bulkhead FIG. 8, 71 unsupported by the nose and permits that bulkhead to be ejected by the inertial forces of the munition cargo as the parachute is deployed and decelelerates the cluster bomb.

The packaging of the munition cargo is effectively identical to that shown in FIG. 1. The tail segment or stabilizer segment as shown in FIG. 8 is composed of four fins 56 90° apart, connected to the rear bulkhead 54 or separator from the cylindrical, munition compartment 53.

A cylindrical compartment 60 within that tail segment as shown in FIG. 8 contains the "parachute," which in the preferred embodiment is an inflatable stabilizer/retarder 58. The compartment is closed off at the tail end with a latched cover 59. The lanyard or cable 69 that connects the pins in the compressed spring, nose spreading mechanism to the parachute is shown in FIG. 8.

Figure 11A:
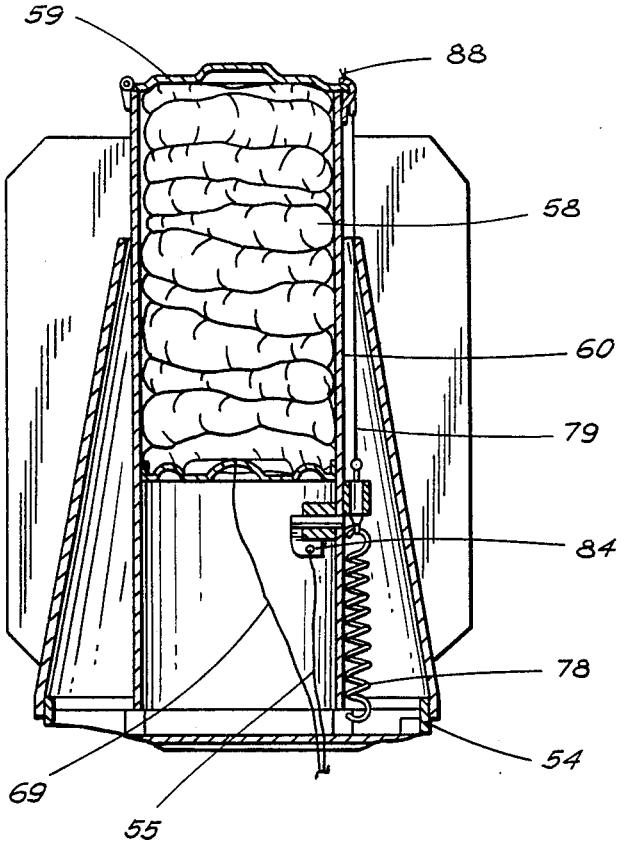
Figure 11B:
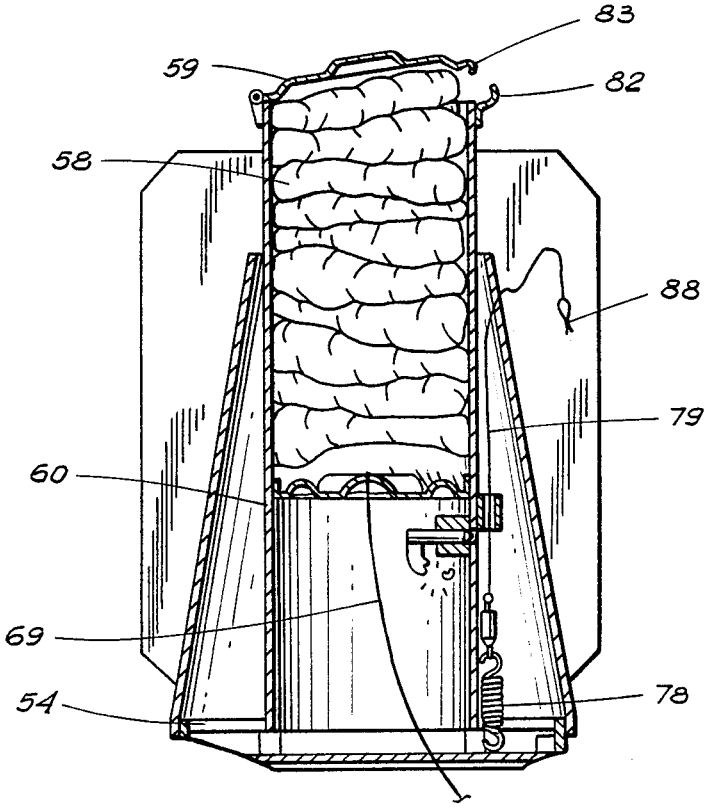
FIG. 11B is a split view showing the system shortly after functioning.
Figure 12B:
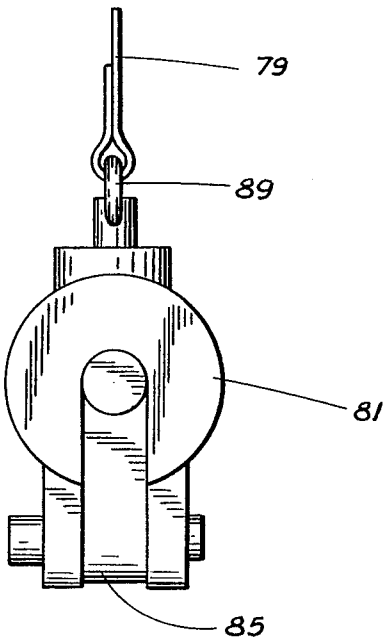
FIGS. 12A and 12B show two 90° apart-sectional views along the longitudinal axis of the tail segment spring loaded release mechanism used to open the tail end closure shown as segment "VI" in FIG. 8.
Figure 12A:
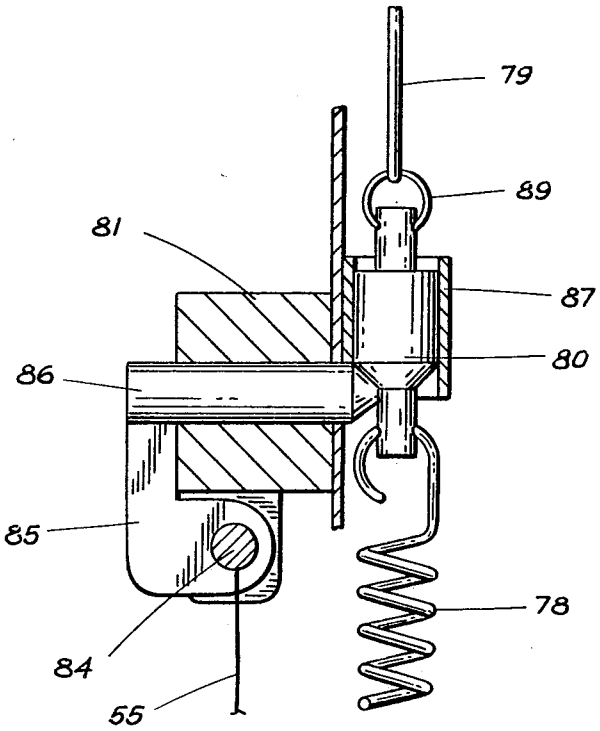

FIG. 11A and 11B show the details of the tail section, "V" of FIG. 8 "parachute" release mechanism before and after functioning, where that release mechanism is also more closely shown in FIGS. 12A and 12B as follows: A spring loaded cable or lanyard 79 is connected by ring 89 connected to a wedge 80 held in position by a stationary retainer 87 against an opposing wedge 86 which is held stationary by a housing 81. A spring in an expanded, pull position 78 is connected to the first wedge 80 but can not exert any force on the lanyard 79, being prevented from doing so by the opposing wedge 86 held in the cylindrical casing 81 and also in place in a pinned segment 85. The pinned segment 85 is provided with a detonator 84 in the pin position. The low energy detonating cord 55 is connected to and caused to initiate the detonator. For safety purposes, to assure safe separation in case of fuze malfunctioning, the detonator 84 may be a delay detonator, functioning after a time delay to provide that safe separation. The detonator 84 is capable of destroying the pinned segment and thereby permitting wedge 86 to withdraw and release wedge 80 to permit the spring 78 to contract and pull on lanyard 79. As shown in FIG. 11B, this cable or lanyard 79 then pulls the pin 88 out of the spring loaded latch 83 fitting over lip 82 of closure or cover 59 thereby releasing the cover 59 and the "parachute," which are partially ejected and pulled by air pressure into the air stream where the "parachute", i.e. the stabilizer/retarder begins to inflate.

As the "parachute" type of inflatable stabilizer/retarder 58 is pulled by the high velocity air into the air stream the cable or lanyard 69 is pulled tight. It is connected through tubing 72 (FIG. 8) running along the inner wall of the cluster bomb to the nose section, where it is connected to the two pins 103 (FIG. 9) that keep the front end nose section release mechanism from functioning. The cable or lanyard 69 withdraws the two pins 103 (FIG. 9) as the parachute is being pulled out further by the air stream. This causes the nose section 52 of FIG. 8 to be pushed apart by the spring loaded rod 98 (FIG. 9) acting under the pressure of the released compressed spring 100.

As shown in FIG. 10 the 2 nose section 52 of the preferred embodiment B rotate around their open hinges 76, until they separate from the pins 77 and fall past the bomb.

The fuze 51 of FIG. 8 which may stay with one of the 2 segments and is similarly released.

The forward bulk-head 71 of FIG. 8 is no longer supported by the nose section. The "parachute" inflatable stabilizer/retarder 58 begins to fully inflate. Upon full inflation and being connected to the tail section it causes a sufficient sudden deceleration of the bomb so that the contained munition cargo 62 (FIG. 8) overcomes both inertia and the binding and frictional forces of the packing holding it in the cylindrical body 53 and it pushes against the loose front bulkhead, overcoming the air pressure against it and forcing it to give way.

The basic dispersalsystem and advantages thereof is applicable to both of the preferred embodiments. In both cases the bomblet munition pay load as a result of its inertia is forced out of the open nose section into the air stream, where the bomblets are dispersed by it, by being forced to have an angle of attack at an angle to the flight of the cluster bomb. The high pressure incident air, impinging on the tightly packed cluster of bomblets, tilts the same at an angle to the flight of the cluster bomb and this causes the dispersion which is surprisingly, equivalent to that obtained by the more costly, complex and more hazardous dispersion system of prior art. Thus, there is no loss of velocity in the ejection system here. The bomblets retain the velocity of the cluster bomb and use this velocity to obtain an angular dispersion as a result of the impinging air, which drives the tightly packed bomblets apart and forces them to take on a considerable outward angle from the flight direction of the cluster. This causes the dispersion. The dispersion, previously widely used causes a high "drag" or degradation in velocity resulting from air frictional forces. The high drag side dispersion is consequently not an efficient dispersion system in spite of the spin used to obtain dispersion. Where under similar conditions of drop at medium altitudes and speeds a dispersion over an area of 50,000 $m^2$ was obtained with the prior explosively opened spin activated dispersion systems, the same degree of coverage was obtained with this forward deploying bomblet system.

I claim:

1. An improved cluster bomb comprising
(a) cylindrical casing having fins at its rear end to impart aerodynamic stability and adapted to deploy over a target
(b) said cylindrical casing containing a cargo of ammunition in a central section, which is connected to a front end nose section and a rear tail end section
(c) said front nose section having frangible connections therein adapted to being split apart
(d) a spring loaded rod, held in a compressed loaded condition by a base cover and a holding means in the rod, said rod in a first surrounding tubular cylinder extending from the nose section rearwardly into the rear end section
(e) said rear end section containing at the rear thereof a latched cover plate on the section containing underneath inflatable stabilizer/retarder braking means attached to the cluster bomb
(f) said latched cover plate being held by a pin in a spring loaded latched condition and said pin being adapted to be pulled out by means attached to the spring loaded rod
(g) a programmable time fuze to effect a detonation in said nose section, whereby functioning of the detonator destroys the nose section holding the rod in a spring loaded position, and fully opens the nose end while permitting rapid movement of the rod under the spring force to cause removal of the pin holding the latched cover plate covering the inflatable braking means permitting the inflatable braking means to be engaged by the surrounding air stream and to inflate whereupon a sudden braking of the entire assembly occurs causing the cargo of ammunition to move forward in the direction of flight of the cluster bomb as a result of inertia while the entire assembly is braked by the braking device.

2. An improved cluster bomb according to claim 1 in which said means attached to the spring loaded rod in part (f) comprise a spring maintained in a stretched position attached to the means holding the spring loaded latch in closed position, whereby on movement of the rod said spring in stretched position contracts to remove the pin holding said latched cover plate.

3. An improved cluster bomb according to claim 2 in which said spring load latched cover plate on the rear end section is hinged on the side opposite the pin, whereby when the pin is withdrawn and the latch cover opens it separates from the rear end section.

4. An improved cluster bomb according to claim 3 in which the spring loaded rod pressing against the movable rear end of the inflatable stabilizer/retarder breaking means containing compartment, pushes said breaking means further out into the air stream to increase the rapidity of inflation.

5. An improved cluster bomb according to claim 4 wherein said front nose includes a frangible matrix and, wherein said first tubular cylinder includes a second cylindrical inner tube which rests on a wedged shaped support that is housed in said frangible matrix, a cable connected at a first end to the rear end of said second cylindrical tube, said cable passing forward of said second tube's rear end, and rearward of said wedged shaped support, into a space between said second and said first tubes and, said cable being attached at a second end, rearward of said first tubular cylinder, for receiving rearward movement from the spring loaded rod, for imparting forward movement to said first tube by said cables first end.

6. An improved cluster bomb comprising
(a) a cylindrical casing having fins at its rear end to impart aerodynamic stability and adapted to be deployed over a target
(b) said cylindrical casing containing a cargo of ammunition in a central section, which is connected to a front end section and a rear end section
(c) said front end section having frangible connections therein adapted to being split apart
(d) said front end section containing a spring loaded rod in a crosswise position therein and bearing against said front end section and adapted to force the front end sections apart upon release of the spring
(e) said spring loaded rod being held in loaded condition by a pin attached by cable means to a latched cover on the rear end section holding a drag device in said rear end section
(f) said latched cover plate being held by a pin in a spring loaded latched condition and, holding means, releasable by detonation, for holding said spring loaded pin in said latched condition
(g) a programmable timer fuze which on functioning fires an initiator that transfers that initiation to said holding means for detonating said holding means holding the pin in said latched condition,
(h) said drag device in said rear end section being inflatable stabilizer/retarder braking means attached to the cluster bomb whereby, upon detonation, release of the latch cover in the rear end section occurs, resulting in the deployment of the braking means which pulls said cable means to remove the pin holding the spring loaded rod in said front end section; whereby the rod expands and opens said front end sections; and furthermore said inflatable stabilizer/retarder braking means being engaged by the surrounding air stream inflates for suddenly braking the entire assembly, causing the cargo of ammunition to move forward as a result of inertia while the entire assembly is braked by the braking device.

7. An improved cluster bomb according to claim 6 in which said holding means for said latch cover plate pin comprises a spring held in a stretched condition by wedge means, said wedge means separable by detonation for permitting the spring to contract and pull the pin from holding the latched cover.

8. An improved cluster bomb according to claim 7 in which said latched cover plate on the rear end section is hinged on the side opposite the pin, whereby when the pin is withdrawn the latch cover opens and the cover plate separates from the rear end portion.

* * * * *